United States Patent [19]

Lafeber

[11] 4,114,820

[45] Sep. 19, 1978

[54] YARN WINDING APPARATUS

[75] Inventor: Andre Lafeber, Oestringen, Fed. Rep. of Germany

[73] Assignee: Imperial Chemical Industries Limited, London, England

[21] Appl. No.: 762,152

[22] Filed: Jan. 24, 1977

[30] Foreign Application Priority Data

May 28, 1974 [GB] United Kingdom ..... 23508/74

Related U.S. Application Data

[63] Continuation-in-part of Ser. No. 578,813, May 9, 1975, abandoned.

[51] Int. Cl.[2] ..... B65H 67/04

[52] U.S. Cl. ..... 242/18 A; 242/18 PW

[58] Field of Search ..... 242/18 A, 25 A, 18 DD, 242/56 A, 64, 18 PW

[56] References Cited

U.S. PATENT DOCUMENTS

| | | | |
|---|---|---|---|
| 1,345,900 | 7/1920 | Stone | 242/18 A UX |
| 2,905,402 | 9/1959 | Foller et al. | 242/18 A |
| 3,409,238 | 11/1968 | Campbell et al. | 242/18 A |
| 3,521,826 | 7/1970 | Schmick | 242/18 A |
| 3,532,278 | 10/1970 | Sparling | 242/18 A |
| 3,559,902 | 2/1971 | Brock | 242/18 A |
| 3,856,222 | 12/1974 | Wust | 242/18 A |
| 3,857,522 | 12/1974 | Fink | 242/18 A |
| 3,865,321 | 2/1975 | Miller | 242/18 A |

FOREIGN PATENT DOCUMENTS

| | | | |
|---|---|---|---|
| 874,945 | 4/1953 | Fed. Rep. of Germany | 242/18 A |

*Primary Examiner*—Stanley N. Gilreath

*Attorney, Agent, or Firm*—Cushman, Darby & Cushman

[57] ABSTRACT

A yarn winding apparatus of the type for winding yarn on cores comprising a drive roll; a rotatable head carrying on one side thereof two chuck carriers and chucks for holding cores, projecting from the rotatable head at right angles, the axis of the rotatable head being offset from the axis of the drive roll such that the carriers and chucks are wholly disposed on one side of the drive roll and the rotatable head being carried on a shaft which extends only from the side of the head opposite the carriers and chucks, the chuck carriers being carried on guide rails mounted on said head, the guide rail for one chuck carrier being laterally spaced to one side of the head axis, and in a plane perpendicular to the head axis, while the guide rail for the other chuck carrier is laterally spaced to the other side of the head axis, also in a place perpendicular to the head axis, the guide rails being long enough to allow the chuck carriers to pass over and under the rotatable head axis and to pass each other, to allow the maximum package diameter to be greater than the distance between the axis of the rotatable head and the nearest surface of the drive roll; means for moving and controlling the position of the chuck carriers on the guide rails; and yarn handling means for transferring and cutting the yarn when required.

1 Claim, 7 Drawing Figures

YARN WINDING APPARATUS

This is a continuation-in-part of Application Ser. No. 578,813 filed May 9, 1975, now abandoned.

This invention relates to improved apparatus for winding yarn into packages and for changing an empty package core or bobbin for a full package, with automatic transfer of the yarn.

A number of machines devised for solving this problem are available or have been proposed but these have limitations as to the size of package which can be carried, the general convenience and compactness of the machine or the limited speed of operation of the changing cycle.

Machines of the general type with which the present invention is concerned include a drive roll, against which is urged an empty package core, upon which a package is built up as yarn is wound onto the core, and a rotatable head upon which two or more core carrying chucks are mounted. Rotation of the head serves to change a full package for an empty core and means is provided for transferring a yarn from the package to the core.

An example of a prior art machine is given in U.S. Pat. No. 1,345,900, which although for cloth winding, includes a drive roll and a rotatable head carrying the package to be wound. The package is urged against the drive roll by a rack and pinion system carried on the head. The head includes an axial shaft and two parallel package carriers. The axial shaft limits the maximum diameter of the package which can be prepared to the distance between the drive roll and the axial shaft. Hence the means for urging the package against the drive roll need cause movement towards and away from the drive roll of no more than half the diameter of the maximum possible package. Such an axial shaft is also present in the machine described in U.S. Pat. Nos. 3,532,278 and 3,559,902.

In U.S. Pat. No. 2,905,402 (German Pat. No. 1,148,695 is similar) the limiting axial shaft is omitted but a complex gear operated package carrier arrangement sweeps packages through a larger space than is acceptable in a modern compact machine.

U.S. Pat. Nos. 3,409,238, 3,521,826 and 3,856,222 are representative of a type of machine in which there is a rotatable head with two package carriers wherein the distance between the package carriers is fixed. With such a machine, the maximum package size is again limited since the maximum package radius must be less than the distance between its axis and the empty opposite core. Also, with such a machine a full package must be removed quickly to ensure that this maximum radius is available.

A further type of machine is described in U.S. Pat. Nos. 3,856,321 and 3,857,522 wherein the drive roll is situated between the full package and empty cores, and in U.S. Pat. No. 3,857,522 has its axis coincident with the rotatable head assembly. Such an arrangement gives rise to the same problems as the central shaft mentioned above, but more so, since the drive roll is usually larger than a simple support shaft.

An object of the present invention is to provide an apparatus for yarn winding and package changing which allows the build-up of packages of diameter larger than the distance between the turret rotation axis and the drive roll surface. Another object of the invention is to provide a compact machine, with a reduced period of loss during the yarn transfer process. Another object of the invention is to provide a machine which can carry a full package while a second package is building up, without the need for rapid operator attention to remove it, or a complex automatic package removal system.

The present invention provides a yarn winding apparatus of the type for winding yarn on cores having (a) a drive roll, (b) a rotatable head carrying two chuck carriers and chucks for holding cores, projecting from the head at right angles (c) yarn handling means for transferring and cutting the yarn when required (d) the axis of the rotatable head being offset from the axis of the drive roll such that the chucks are wholly disposed on one side of the drive roll, in which the improvement comprises mounting the chuck carriers on guiderails which are perpendicular to the rotatable head axis and which are long enough to allow the chuck carriers to pass over and under the rotatable head axis and to pass each other, to allow the maximum package diameter to be greater than the distance between the axis of the rotatable head and the nearest surface of the drive roll.

The core holders of the apparatus of the present invention are preferably rotatable chucks over which a tubular former, or core, upon which the yarn package builds up may slide. The core upon which winding is taking place is driven by a friction drive roll which bears against the yarn wound on the former. The chucks are mounted with their fixed shafts on carriers provided with bearings for sliding along the guide rails fixed to the rotatable assembly. The sliding motion of the carriers is controlled by pneumatic cylinders also mounted on the assembly. In this way the whole assembly may be rotated to interchange the positions of the chucks. The two chucks then may be interchanged by rotation of the assembly through 180°. We prefer that the rotatable assembly is fixed to a drive shaft having a bearing housing mounted in a fixed position on a main frame. The rotation may be effected by a cam drive or gear mechanism, or other means.

The chuck carriers are mounted to slide individually on the rotatable assembly so there is no need for a sliding movement of the whole assembly or the drive roll as only one package with chuck and carrier slides during winding. The package moves against the pressure in the pneumatic cylinder and as the sliding friction is low, accurate pressure control and adjustment is possible with a fine regulation of the pressure in the cylinder.

Our preferred apparatus includes yarn handling means comprising a yarn suction device, or aspirator, and a yarn cutter which may be activated to interupt the feed of the yarn. Thus, when the winding of one package is completed the yarn holding device and the yarn cutter may be activated to interupt the feed of yarn to that package. The assembly is then rotated to bring the fresh core into the winding position and after the fresh core is pressed against the friction drive roll the yarn suction device may be moved to bring the yarn into winding contact with the new core.

We prefer that a small groove be formed in the end of the core tube into which the yarn will slide and clamp itself when the suction device is brought inside the tube. A yarn traverse guide should be positioned so that immediately after the yarn slides in the core groove, it will be automatically taken up by said guide. The aspirator or the fixed shaft of each chuck is preferably provided with a yarn cutter. We prefer to use a ring with sharp hardened edge fixed to the end of the axis of the chuck so that as the inlet of the aspirator slides into the core and cutting ring the yarn rotating with the chuck will cut itself over the sharp edge.

During winding of a fresh package the chuck carrying a full package should preferably be as far away as possible from the package being wound but when winding is complete and one full package has been doffed the empty chuck should be moved towards the full package so that the head may be rotated with the core holders close together thus requiring a comparatively small turning circle. Once the head has been rotated through 180° the chucks may be moved apart to allow sufficient room for winding to start on the new former whilst allowing the fully wound package to be removed and replaced by a new former. The various operations of the apparatus may be synchronised and automated to ensure that as little time as possible elapses between cutting the yarn when the winding of one package is complete and feeding the yarn to the next core. The rotatable head is wholly disposed to one side of the drive roll to simplify operation.

The invention allows the yarn to be fed to the package with a short yarn path between the traverse and the nip of the package and the drive roll. In this way the yarn will not wander on the package and there is good control over the build of the package. In addition since the package moves against the pneumatic pressure in the cylinder, the pressure between the package and the drive roll may be accurately controlled by careful adjustment of the pressure in the cylinder.

The invention will be described further with reference to an example of a yarn winder shown in FIGS. 1 and 2.

Figure 1:
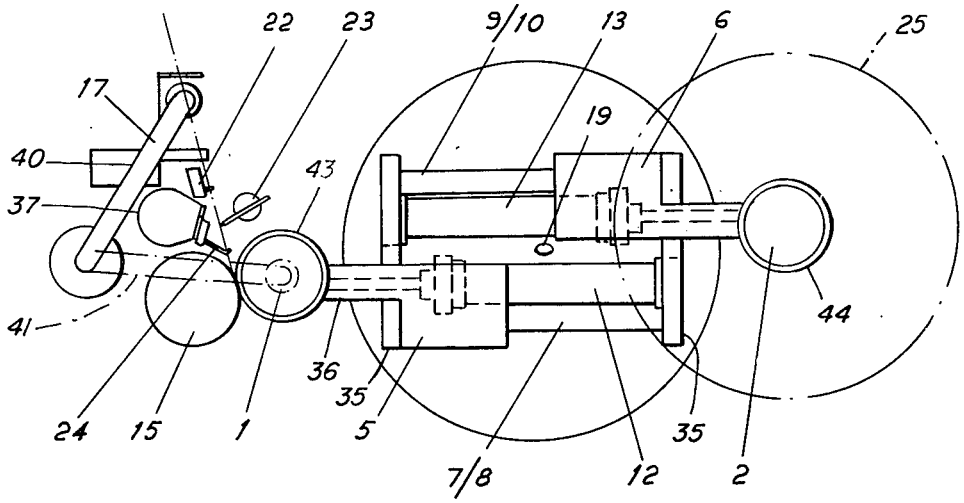
FIG. 1 is a front view of the winder and FIG. 2 is a view from above of the winder of FIG. 1.
Figure 2:
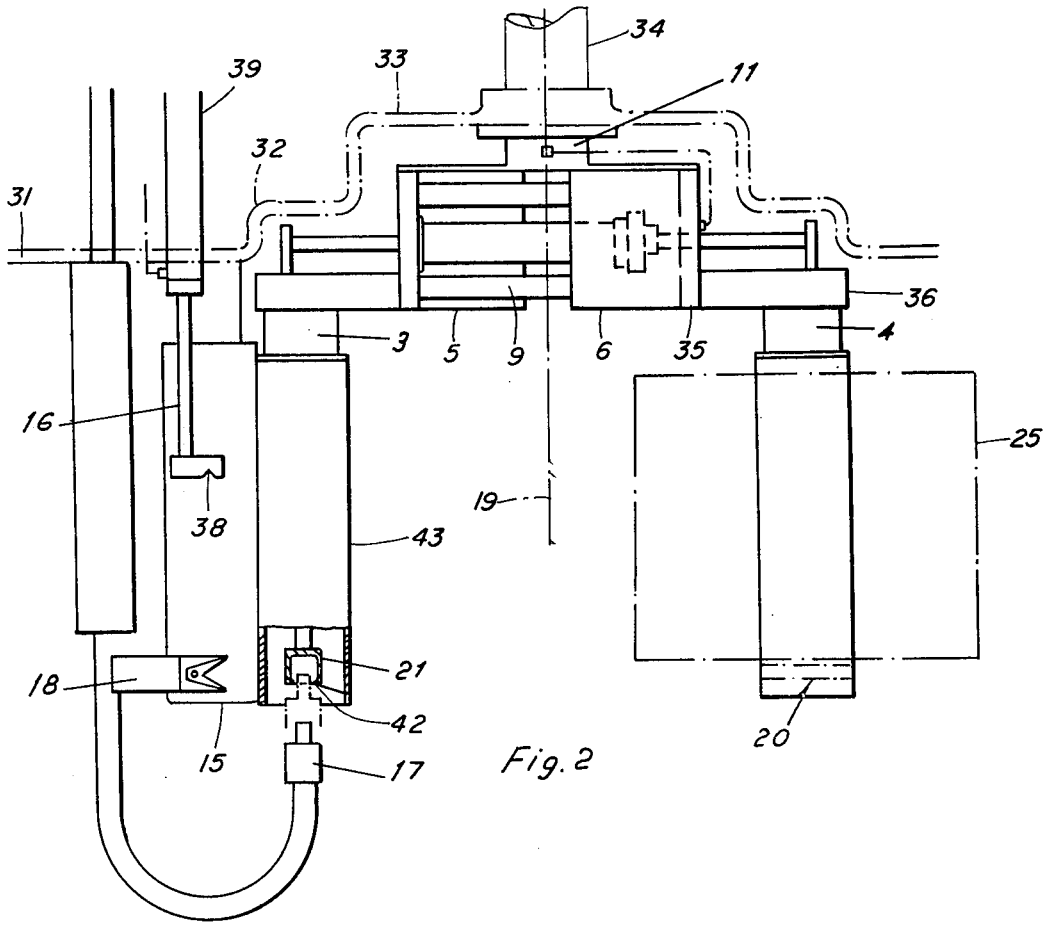

The operational parts of the winder are mounted on a panel 31. The panel is recessed at 32 and further at 33 to contain a rotatable head 11, the shaft 34 projects behind the panel and is driven by conventional means to allow rotation through 180°. The head 11 carries brackets 35 between which are mounted guide rods 7,8,9 10 Carriers 5 and 6 are slidably mounted on these by means of roller bearings (not shown). Extension pieces 36 from the chuck carriers 5 and 6 support shafts 3 and 4 and chucks 1 and 2 on which empty cores 43 and 44 respectively, or bobbins may be mounted. Two pneumatic cylinders 12 and 13 control independently the positions of the chucks. The cylinders are fed through air tubes (not shown) passing through the panel 31.

The guide rails 7,8,9, 10 are long enough to allow chuck carriers 5 and 6 to cross the head axis 19 and to pass, one over and one under said axis. Also mounted on the panel 31 is a drive roll 15 and associated yarn handling equipment. Distribution of yarn is controlled by a traverse guide 24 driven from a roll in the traverse box 37. Yarn is caught by means of yarn presentor 16 having a notch 38, which coincides with the yarn path 39. The presentor is driven parallel with the drive roll axis by a pneumatic cylinder 39. Yarn is cut by a knife 18 and transferred by means of an aspirator 17 capable of being moved by actuators (not shown) in a direction parallel with the drive roll axis and also in rotation between positions 40 and 41 in FIG. 1. In position 40, the yarn presentor 16, knife 18 and aspirator nozzle 17 all coincide with the yarn path to collect, cut and aspirate the yarn. In position 41 the vaspirator nozzle can enter a stationary ring knife 21 which comprises a short cylinder of steel with a sharpened outer end cutting edge 42. Package cores 43 and 44 are provided with a notch 20 to catch yarn.

The operating sequence of the winder is controlled by an an electropneumatic programmer (not shown) and is as follows. In FIG. 1, a new package has just been started. Drive roll 15 rotates clockwise and the core 43 is urged against it. Yarn traverse 24 is conventional. As the package builds up pneumatic pressure in cylinder 12 is controlled to give constant force against the drive roll. Carrier 5 slides along its rail to cross axis 19 thereby allowing the formation of a package of greater diameter than the distance between the contact point with the drive roll and the axis of the rotatable head. When the package is full, either automatically or manually the transfer cycle is initiated. Presentor 16 advances the yarn to aspirator 17 at position 40. The yarn is caught by the presentor 16, cut against the knife 18 and drawn into the aspirator 17. Cylinder 12 withdraws the full package from the drive roll and the head rotates 180° to bring the next empty package against the drive roll. Cylinder 12 (now 13) moves the full package away from the drive roll so that it can be removed at some time during the next cycle and is well clear of the filling package. Aspirator 17 rotates to position 41 and enters the ring knife 21. Yarn is caught in the tube notch 20 and thus pulled against the ring knife edge 42 to cut it. The presentor has been withdrawn and the yarn engaged by traverse guide 24 to continue winding.

FIGS. 3–7 illustrate the operation more in detail.

Figure 3:
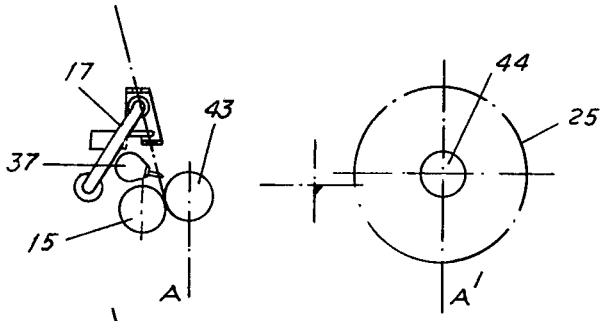
FIGS. 3-7 are diagrammatic illustrations of a package change and the automatic yarn transfer using the apparatus of FIGS. 1 and 2.
Figure 4:
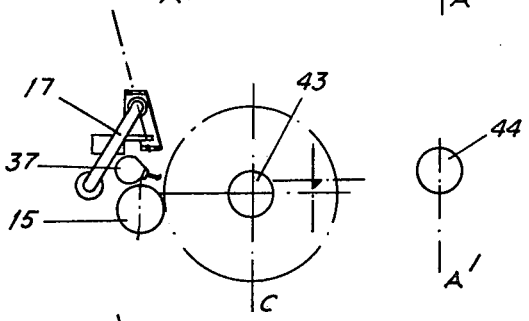

FIG. 3 shows the situation in which the whole assembly has been rotated to take a fully wound package 25 away from the winding position and a fresh core 43 to the winding position. The yarn is then wound on the core 43 so that the resulting package increases in diameter to the size shown in FIG. 4; during this time the center of the core 43 moves from the position A to position C.

Figure 5:
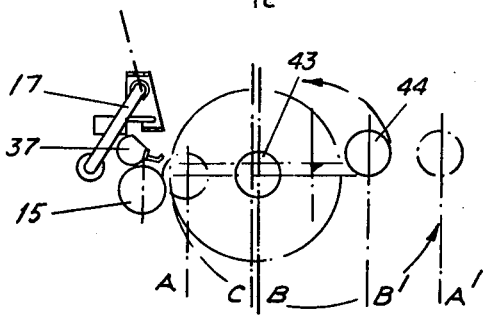

With the winding up on the core 43 complete, and after the yarn has been severed, the core 44 is moved from its position A′ to B′ and the center of core 43 moved to position B so that the fully wound package is clear of the drive roll 15, the situation now being as shown in FIG. 5.

Figure 6:
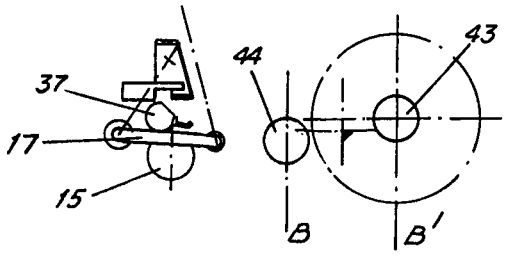
Figure 7:
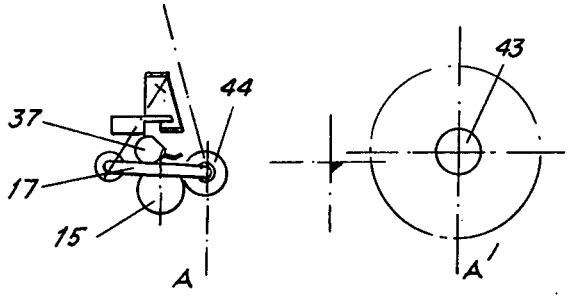

The whole assembly is then rotated through 180° as shown by the dotted arrows in FIG. 5 to interchange the positions of the two tube holders as shown in FIG. 6. After this rotation the core 44 is then moved from position B to position A where it presses against the drive roll 15. At the same time core 43 moves into the position A′ where the wound package can be removed and replaced by an empty tube. This situation is shown in FIG. 7.

We claim:

1. A yarn winding apparatus of the type for winding yarn on cores comprising a drive roll; a rotatable head carrying on one side thereof two chuck carriers and chucks for holding cores, projecting from the rotatable head at right angles, the axis of the rotatable head being offset from the axis of the drive roll such that the carriers and chucks are wholly disposed on one side of the drive roll and the rotatable head being carried on a shaft which extends only from the side of the head opposite the carriers and chucks, the chuck carriers being carried on guide rails mounted on said head, the guide rail for one chuck carrier being laterally spaced to one side of the head axis, and in a plane perpendicular to the head axis, while the guide rail for the other chuck carrier is laterally spaced to the other side of the head axis, also in a place perpendicular to the head axis, the guide rails being long enough to allow the chuck carriers to pass over and under the rotatable head axis and to pass each other, to allow the maximum package diameter to be greater than the distance between the axis of the rotatable head and the nearest surface of the drive roll; means for moving and controlling the position of the chuck carriers on the guide rails; and yarn handling means for transferring and cutting the yarn when required.

* * * * *